US007195660B2

(12) United States Patent
Little et al.

(10) Patent No.: US 7,195,660 B2
(45) Date of Patent: Mar. 27, 2007

(54) PILLOW WITH AIR FILTER

(75) Inventors: Baird M. Little, Nashua, NH (US); Steven H. Schwartz, Bedford, NH (US)

(73) Assignee: Brookstone Purchasing, Inc., Merrimack, NH (US)

( * ) Notice: Subject to any disclaimer, the term of this patent is extended or adjusted under 35 U.S.C. 154(b) by 46 days.

(21) Appl. No.: 10/827,782

(22) Filed: Apr. 20, 2004

(65) Prior Publication Data

US 2005/0229557 A1 Oct. 20, 2005

(51) Int. Cl.
*A47G 9/00* (2006.01)
*A62B 7/00* (2006.01)

(52) U.S. Cl. ..... 55/385.1; 55/385.2; 55/467; 55/563; 55/471; 55/473; 55/DIG. 39; 454/187; 607/96; 607/114; 607/109; 607/112; 606/20; 606/27; 5/636; 5/644; 5/641; 5/643; 5/630; 5/651

(58) Field of Classification Search ..... 55/385.1, 55/385.2, 385.3, 467, 471, 473, DIG. 39, 55/563, 363; 454/187; 607/109, 114, 112, 607/96; 606/20, 27; 5/636, 644, 643, 641, 5/630–651
See application file for complete search history.

(56) References Cited

U.S. PATENT DOCUMENTS 3,097,505 A * 7/1963 Smith ..... 62/261
3,638,255 A * 2/1972 Sterrett ..... 5/641
4,523,588 A * 6/1985 Dolsky ..... 128/201.25
4,977,634 A * 12/1990 Koji ..... 5/638
5,148,564 A 9/1992 Reder
5,522,105 A * 6/1996 Fujiwara et al. ..... 5/644
5,692,954 A * 12/1997 Lee et al. ..... 454/187
5,706,535 A * 1/1998 Takashima ..... 5/485
5,918,333 A * 7/1999 Takashima ..... 5/641
6,009,577 A 1/2000 Day
6,136,057 A * 10/2000 Dang et al. ..... 55/385.3
6,230,349 B1 * 5/2001 Silver et al. ..... 5/636
6,471,746 B2 * 10/2002 Hagglund et al. ..... 95/78
6,514,324 B1 * 2/2003 Chapman ..... 96/67
6,532,611 B1 3/2003 Day
6,540,804 B1 * 4/2003 Wennerstrom ..... 55/472
6,632,407 B1 10/2003 Lau et al.
6,640,049 B1 10/2003 Lee et al.
6,760,937 B1 * 7/2004 Ou ..... 5/652.1
2002/0092097 A1 * 7/2002 Lee ..... 5/644
2003/0055473 A1 * 3/2003 Ramsden et al. ..... 607/109
2003/0165410 A1 9/2003 Taylor
2003/0182725 A1 * 10/2003 Baik ..... 5/640
2004/0047775 A1 3/2004 Lau et al.
2004/0134354 A1 * 7/2004 Johnson ..... 96/16
2005/0210590 A1 * 9/2005 DiGirolamo ..... 5/636

FOREIGN PATENT DOCUMENTS

EP 1222886 A2 * 1/2002

* cited by examiner

*Primary Examiner*—Minh-Chau T. Pham
(74) *Attorney, Agent, or Firm*—Nixon Peabody, LLP

(57) ABSTRACT

A travel pillow has one or more air filters and a body with a soft material coupled to the one or more air filters. The air filters can be powered by a power source located within the pillow. The one or more air filters can have an air intake and an air outflow in communication with an exterior surface of the body. The air filters may be an electrostatic precipitator filter or use a filtering material to clean the air.

39 Claims, 10 Drawing Sheets

PILLOW WITH AIR FILTER

FIELD OF THE INVENTION

The present invention is generally related to a pillow with an air filter mounted within the pillow, and more particularly is related to a travel pillow with an air filter directing a flow of filtered air to the user.

BACKGROUND OF THE INVENTION

Travel pillows provide a stable support for the neck. The pillows are typically small and easily stored within luggage. Some travel pillows have a foam core with a fabric cover. The fabric cover can be removed for cleaning. Some travel pillows have a U-shape that wraps around the neck of the user. The U-shaped travel pillow rests on the shoulders of the user and supports the neck and head in an upright position. This allows the user to relax and rest while sitting in an upright position.

Travel conditions often involve being surrounded by people in close quarters. Being in close proximity with a variety of people increases the risk of catching an airborne illness. In addition, vehicles, such as buses, trains, and airplanes, often contain dust and a variety of other foreign airborne particles that can exacerbate allergies. To address these concerns, a variety of filters have been developed to clean the air surrounding an individual. Some filters propel air through a filter material. The filter material allows the air to pass through while the filter catches and traps particles. The filter material is then periodically replaced or cleaned. The filter material can also be laced with chemicals that kill or neutralize germs and bacteria. In addition to neutralizing germs and bacteria, some chemicals are used that absorb odors and objectionable gases.

Another type of air filter is an electrostatic precipitator filter. This type of filter uses an ion generator to inject ions into the stream of air being filtered. The negatively charged ions attach to foreign particles in the air. The air stream passes by positively charged plates. The foreign particles, now negatively charged due to the attached ions are pulled towards the charged plates and magnetically attach to the charged plates. The charged plates are periodically removed and cleaned.

The above described air filters can be used in combination to provide a greater degree of air filtration. For example, a stream of air first can be filtered through a filter material to catch particles having a relatively large diameter. In the next stage, an electrostatic precipitator filter can be used to remove smaller particles that pass through the filter material.

Some of the above filters allow the nature convection currents of air to drive the air though the filtration process. The electrostatic precipitator filter can use the electrostatic forces of the charged particles to pull the surrounding air through the filter. In addition, some filters use a fan or other device to drive a flow of air through the filtering process. Unfortunately, the above-mentioned filters are typically large or cumbersome.

Thus, a heretofore unaddressed need exists in the industry to address the aforementioned deficiencies and inadequacies.

SUMMARY OF THE INVENTION

In one aspect, the invention features a pillow with one or more air filters and a body. The one or more air filters are surrounded with padded material. The pillow may also incorporate a power source coupled to the one or more air filters. Each of the one or more air filters may have an air intake in communication with a bottom or side surface of the exterior surface and an air outflow in communication with a top surface of the exterior surface. The air filters may be an electrostatic precipitator filter or use a filtering material to clean the air. The air filters can also have a fan to aid in drawing air through the filter. The outflow air can be directed at the user with a positionable nozzle on the outflow opening. A power source, for example batteries, can also be incorporated in the padding of the pillow. The pillow provides a portable travel pillow that cleanses the air surrounding the user during use.

Other features and advantages of the present invention will be or become apparent to one with skill in the art upon examination of the following drawings and detailed description. It is intended that all such additional features and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
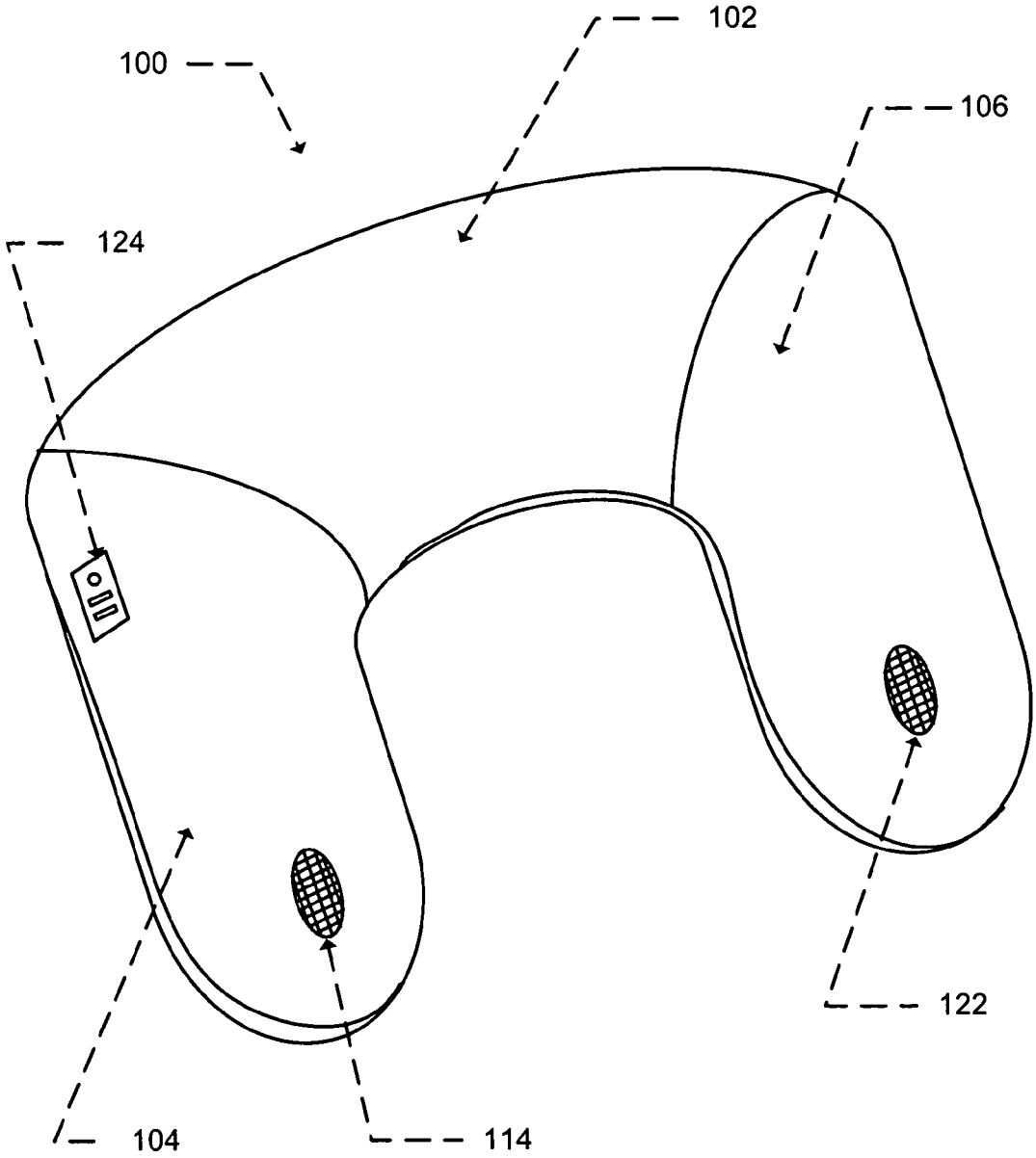
FIG. 1 is a perspective view of the pillow with air filter, in accordance with a first exemplary embodiment.
Figure 2:
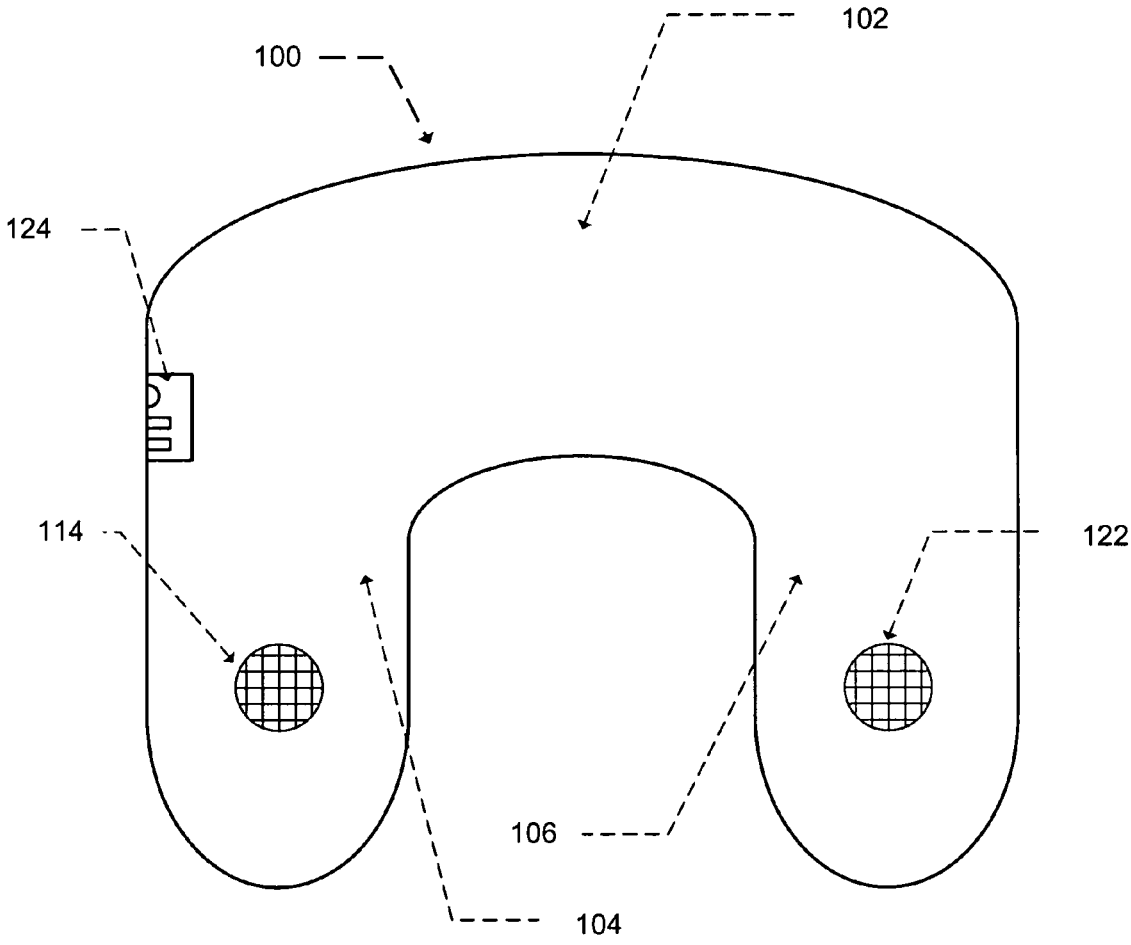
FIG. 2 is a top view of the pillow with air filter of FIG. 1.
Figure 3:
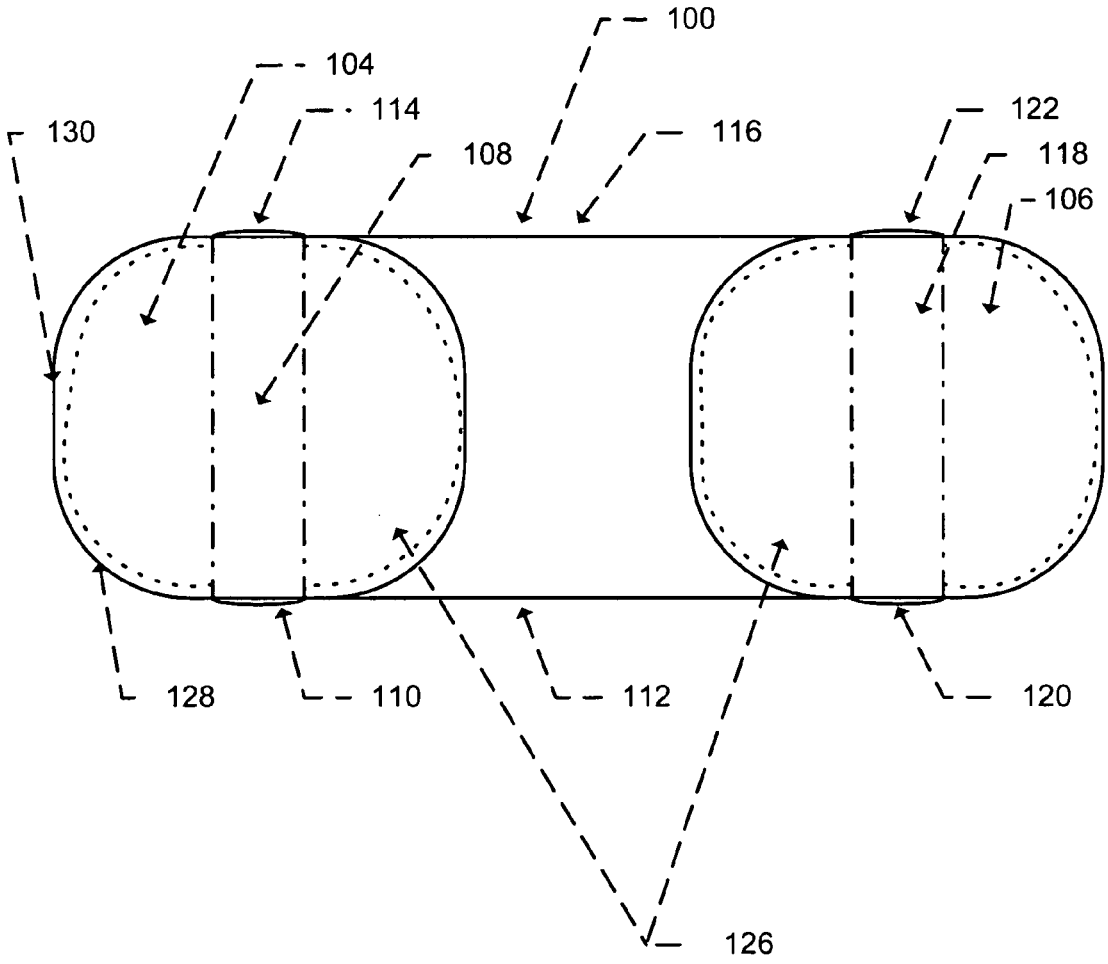
FIG. 3 is a front view of the pillow with air filter of FIG. 1.

FIG. 1 is a perspective view, FIG. 2 is a top view, and FIG. 3 is a front elevation view of the pillow with air filter 100, in accordance with a first exemplary embodiment of the pillow. The pillow with air filter 100, in accordance with the first embodiment, has a U-shape body comprising a back portion 102, a right arm portion 104, and a left arm portion 106. A right chamber 108 runs through the right arm portion 104 with a right intake opening 110 on a bottom exterior surface 112 and a right outflow opening 114 on a top exterior surface 116. Correspondingly, a left chamber 118 runs through the left arm portion 106 with a left intake opening 120 on the bottom exterior surface 112 and a left outflow opening 122 on the top exterior surface 116. Air filters are located in the left chamber 118 and right chamber 108. The air filters receive a flow of air from the intake openings 110 and 120, filter the air within the chambers 108 and 118, and supply cleansed air out of the outflow openings 114 and 122. Exemplary embodiments of the air filters are shown in FIGS. 6–10 and described in greater detail later in the specification.

The pillow with air filter 100 has a core 126 made of foam or padding material. The foam material supports the head and neck of the user while providing a soft surface. The core 126 of the pillow can also be made of a variety of other natural or synthetic stuffing materials used in pillow construction, for example but not limited to, cotton, polyester, micro fibers, wool, and bird feathers. Additionally, the core 126 can also be constructed with an inflatable bladder. The inflatable bladder can be constructed of an airtight material. A port (not shown) on the bladder can be provided on the exterior surface of the pillow with air filter 100 to allow the user to inflate or deflate the bladder. The inflatable bladder allows the user to inflate the pillow with air filter 100 for use and deflate the pillow for compact storage. A layer of batting can also be provided surrounding the bladder to provide an even softer surface for the user.

The pillow with air filter 100 can also be constructed of a solid frame (not shown) with foam or padding material located between the solid frame and a cover 128 that surrounds the exterior of the pillow 100. The solid frame can be made of a variety of materials, for example, wood, metal, or plastic. The solid frame within the pillow with air filter 100 can support a control panel 124, chambers 108 and 118, and other interior components.

The core 126 and/or frame of the pillow can be surrounded by the cover 128. The cover 128 can be made of a variety of materials, for example but not limited to, fabric, plastic, leather, or vinyl. The cover 128 can be permanently attached to the core 126 by stitching or adhesive. The cover 128 can also be removably coupled to the core 126, for example, by buttons, zipper, or clips. One example of a cover construction can have an opening to allow the core 216 to be stuffed within the cover 128. The opening may then be zippered closed. The removably coupled cover 128 allows the user to remove the cover 128 for cleaning. The cover 128 can also be made with an opening in communication with the intake openings 110, 120 and outflow openings 114, 122 of the chambers 108 and 118. This allows the air to flow in and out without being obstructed by the cover 128. However, the cover 128 can also be constructed without openings. The cover 128 can be made of a material that allows the air to flow through the material. This cover construction provides a protective and aesthetic cover for the intake openings 110, 120 and outflow openings 114, 122 of the chamber.

A control panel 124 located on a side surface 130 of the right arm portion 104 allows the user to activate one or more air filters. The location of the control panel 124 provides easy access by the hands of the user when the pillow with air filter 100 is supporting the head of the user. The control panel 124 is not limited to being located on the side surface 130 of the right arm portion 104. The control panel 124 can instead be mounted on a variety of different locations and surfaces of the pillow with air filter 100. The control panel 124 can contain various displays, switches, and knobs used to control the one or more air filters. For example, the knobs or switches can be used to control the amount of airflow from the one or more air filters or to control the intensity of air filtration. The display can be a Light Emitting Diode (LED) display that shows the current settings of the one or more air filters. The control panel is described in greater detail in the specification relating to FIG. 7.

Figure 4:
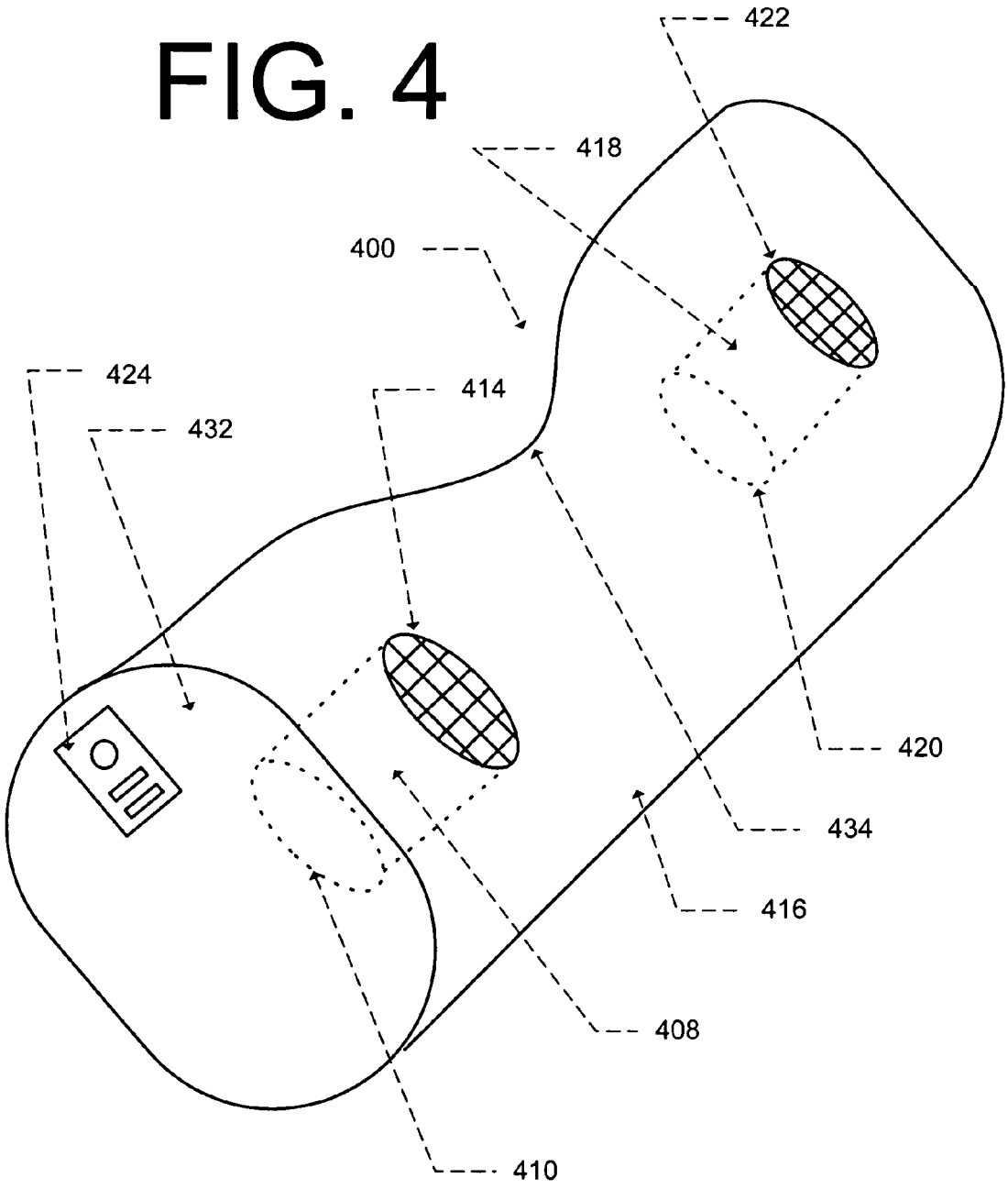
FIG. 4 is a perspective view of the pillow with air filter, in accordance with a second exemplary embodiment.
Figure 5:
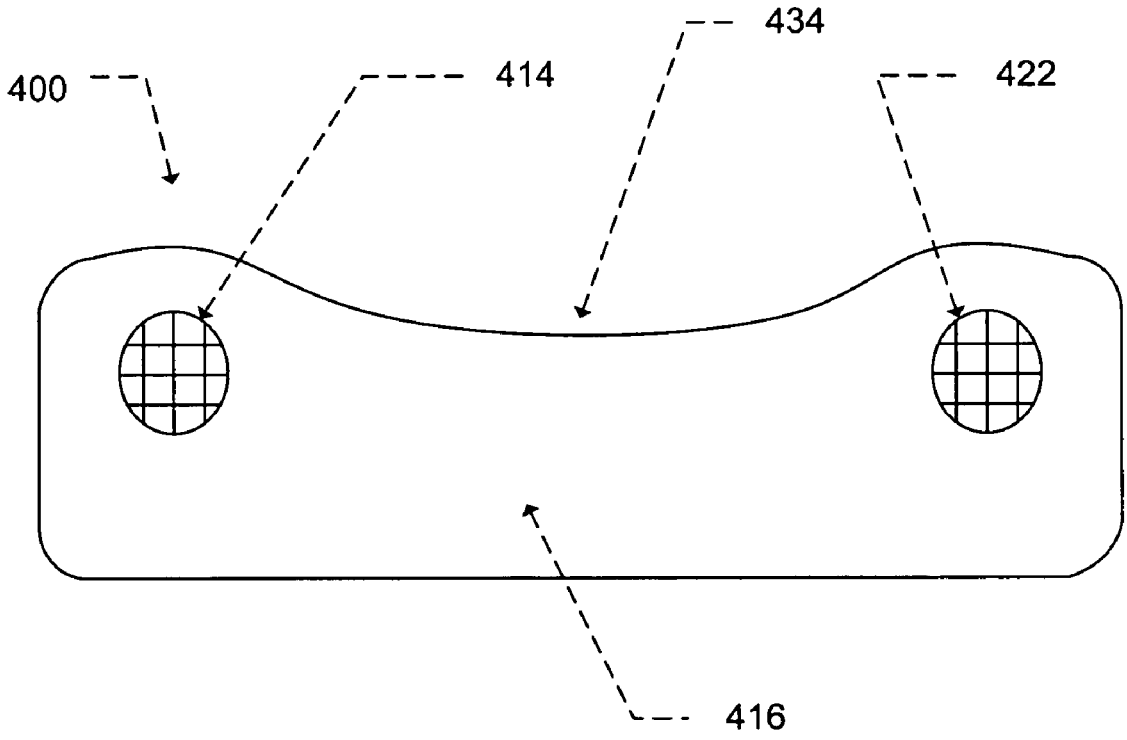
FIG. 5 is a top view of the pillow with air filter of FIG. 4.

FIG. 4 is a perspective view and FIG. 5 is a top view of the pillow with air filter 400, in accordance with a second exemplary embodiment of the pillow. The pillow with air filter 400, in accordance with the second exemplary embodiment, has a rectangular-shaped body with rounded corners. A right chamber 408 runs through a right side of the rectangular-shaped body with a right intake opening 410 on a bottom exterior surface and a right outflow opening 414 on a top exterior surface 416. Correspondingly, a left chamber 418 runs through a left side of the rectangular-shaped body with a left intake opening 420 on the bottom exterior surface and a left outflow opening 422 on the top exterior surface 416. Similar to the first embodiment of the pillow, air filters are located in the left chamber 418 and right chamber 408. The air filters receive a flow of air from the intake openings 410, 420, filter the air within the chambers 408, 418, and supply cleansed air out of the outflow openings 414, 422. A control panel 424 can be located on a right, end surface 432 of the pillow body and allows the user to activate one or more air filters. The control panel 424 is not limited to being located on the right, end surface. The control panel 424 can be located in a variety of different locations and surfaces on the pillow body. An indentation 434 can be provided on the front edge of the body. The neck or back of the head of the user rests within the indentation 434, providing some lateral support for the head of the user. The construction in accordance with the second exemplary embodiment of the pillow is similar to the construction discussed in reference to the first exemplary embodiment of the pillow. One or more chambers run through the pillow with a pillow cover surrounding the pillow core.

The shape of the pillow with air filter is not limited to the shapes and constructions of the pillow in accordance with the first and second embodiments. A variety of other shapes and constructions of the pillow can be used in conjunction with the one or more air filters. The chambers housing the air filters do not have to run through the pillow. Alternatively, the one or more air filters can be coupled to the sides of the pillow.

Figure 6:
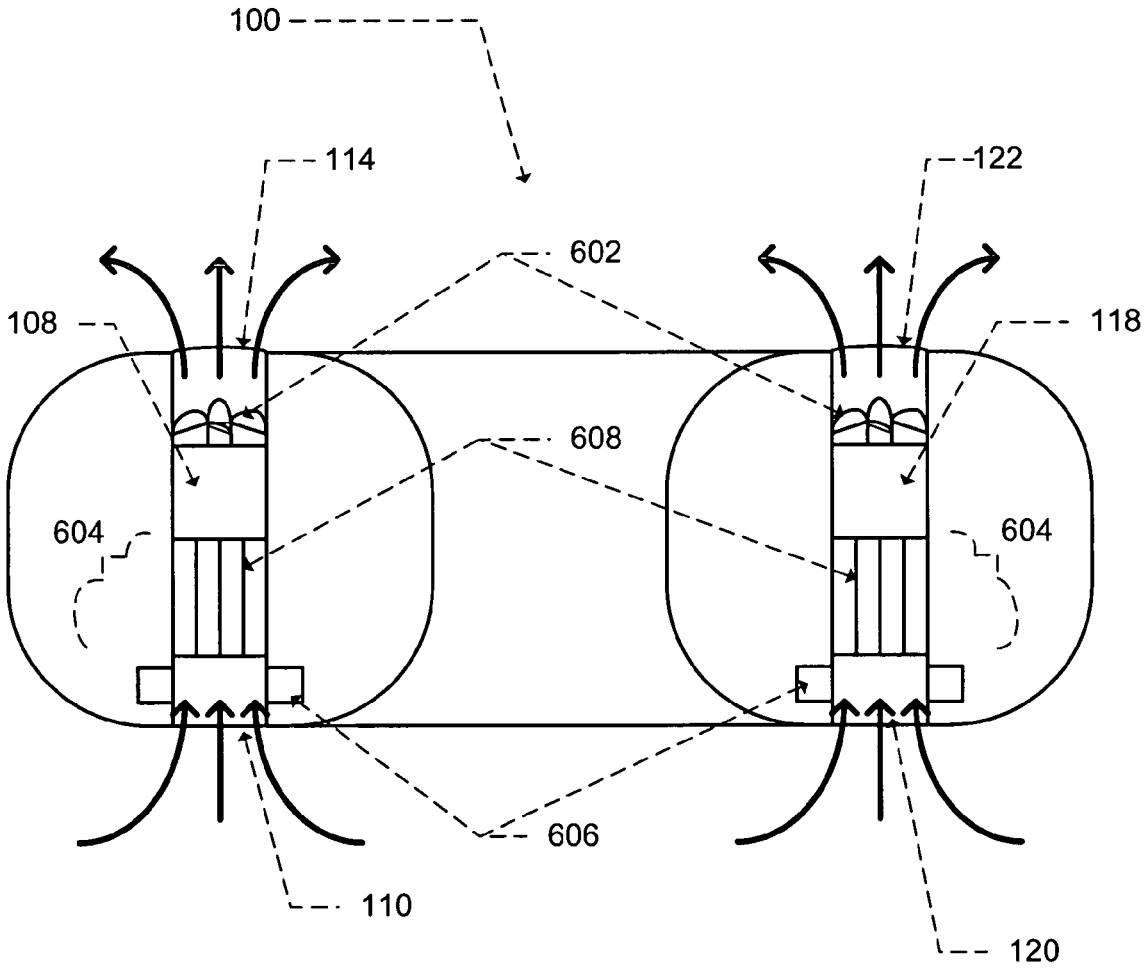
FIG. 6 is a front, cross-sectional view of the pillow with air filter, in accordance with a first exemplary embodiment of the air filter.

FIG. 6 is a front, cross-sectional view of the pillow with air filter 100, in accordance with a first exemplary embodiment of the air filter. The left chamber 118 and the right chamber 108 run through the pillow. In each chamber 108, 118 a fan 602 can be positioned to draw air through the chambers 108, 118. Air is drawn in the intake openings 110, 120 of the chambers 108, 118 and blown out of the outflow openings 114, 122. The air filters shown in FIG. 6 are electrostatic precipitator filters 604. Electrostatic precipitator filters 604 can use an ion generator 606 to inject ions into the stream of air. The negatively charged ions cause the foreign particles in the air, i.e. dust, pollen, germs, and smoke particles, to become negatively charged in an ionization process. The air stream passes by positively charged plates 608. The charge plates 608 lay in a plane parallel to the air stream and perpendicular to the view of FIG. 6. The foreign particles, now negatively charged, are pulled towards the charge plates 608 and magnetically attach to the charge plates 608. The cleaned air stream, with foreign particles removed, flows out of the outflow openings 114, 122 of the chambers 108, 118. The outflow openings 114, 122 of the chambers 108, 118 can be positioned on the exterior surface of the pillow in a direction to facilitate the user breathing in the cleaned air. As discussed in the first and second exemplary embodiment, the outflow openings are located on the top surfaces pointing in a direction that directs the air to the front of the nose and mouth of the user. Of course, the outflow openings may be located in a different location on the pillow with air filter 100.

In addition to locating the outflow openings 114, 122 in a direction that directs the flow of air to the nose and mouth of the user, positionable nozzles (not shown) can be incorporated at the outflow openings 114, 122. A ball and socket joint, for example, can be used to couple the positionable nozzles to the outflow openings 114, 122. The positionable nozzles allow the user to rotate the nozzle and customize the directional flow of clean air.

The charge plates 608 can be constructed with a plurality of plates parallel with the flow of air as shown in FIG. 6. The charge plates can also be constructed as walls lining the chambers 108, 118. A variety of other configurations of the charge plates 608 can be used within the chambers 108, 118. The charge plates 608 can also be removable from the chambers 108, 118. The removable charge plates 608 allow the user to remove the charge plates 608 for periodic cleaning. After a period of use the charge plates 608 can become congested with a buildup of foreign particles that have collected on the charge plates 608. The individual charge plates within a chamber can be coupled together to facilitate removal. A bottom cover can be removed from the intake openings 110, 120 or the outflow openings 114, 122. The user can then remove the charge plates 608 from the chambers 114, 118 and clean the charge plates 608. The charge plates 608 are then placed back into the chambers 108, 118 and are ready for operation.

Figure 7:
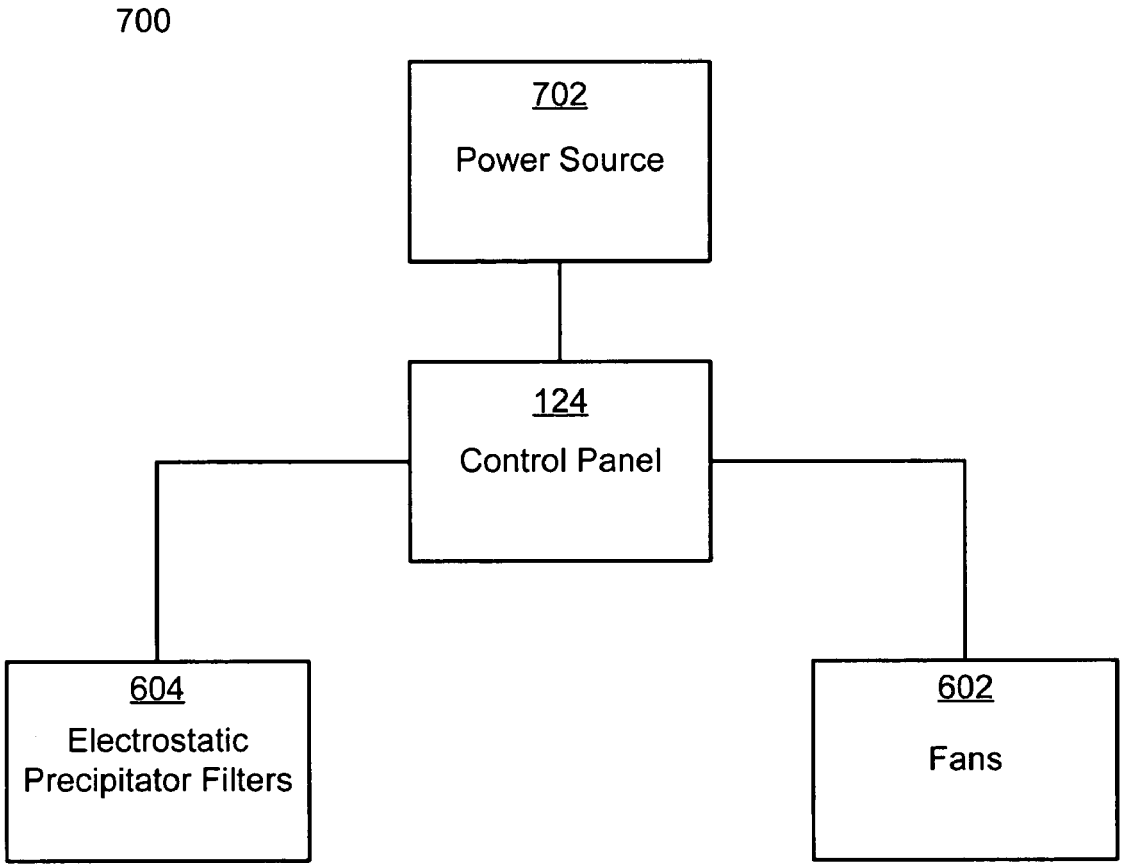
FIG. 7 is a block diagram illustrating interaction of the interior components of the pillow with air filter of FIG. 6, in accordance with the first exemplary embodiment of the air filter.

FIG. 7 is a block diagram illustrating the interaction of air filter components 700 of the pillow with air filter 100 in accordance with the first exemplary embodiment of the air filter. The control panel 124 can be electrically coupled to each electrostatic precipitator filter 604 and fan 602. A power source 702 supplies the power to operate the control panel 124. The control panel 124 selectively supplies power to each electrostatic precipitator filter 604 and fan 602, depending on the control panel setting. The control panel 124 can control each electrostatic precipitator filter 604 and each fan 602 by varying the amount of current supplied to each electrostatic precipitator filter 604 and each fan 602.

The power source 702 can be a battery mounted within the pillow or coupled to an exterior surface of the pillow with air filter 100. In addition to the power source 702 being a battery, the power source 702 can also be an electrical plug that enters through the exterior surface of the pillow with air filter 100. The user would plug the electrical plug into a wall socket to supply the power to run the control panel 124, the one or more electrostatic precipitator filters 604, and one or more fans 602. The power source 702 can also be a combination of the electrical plug and the battery. For example, the power source 702 can be a rechargeable battery that supplies the power for the pillow with air filter 100 when the pillow with air filter 100 is used in a location remote from a wall socket. The pillow with air filter 100 can also have the electrical plug used to recharge the battery or supply power when the pillow with air filter 100 is used in a location within reach of a wall socket.

Figure 8:
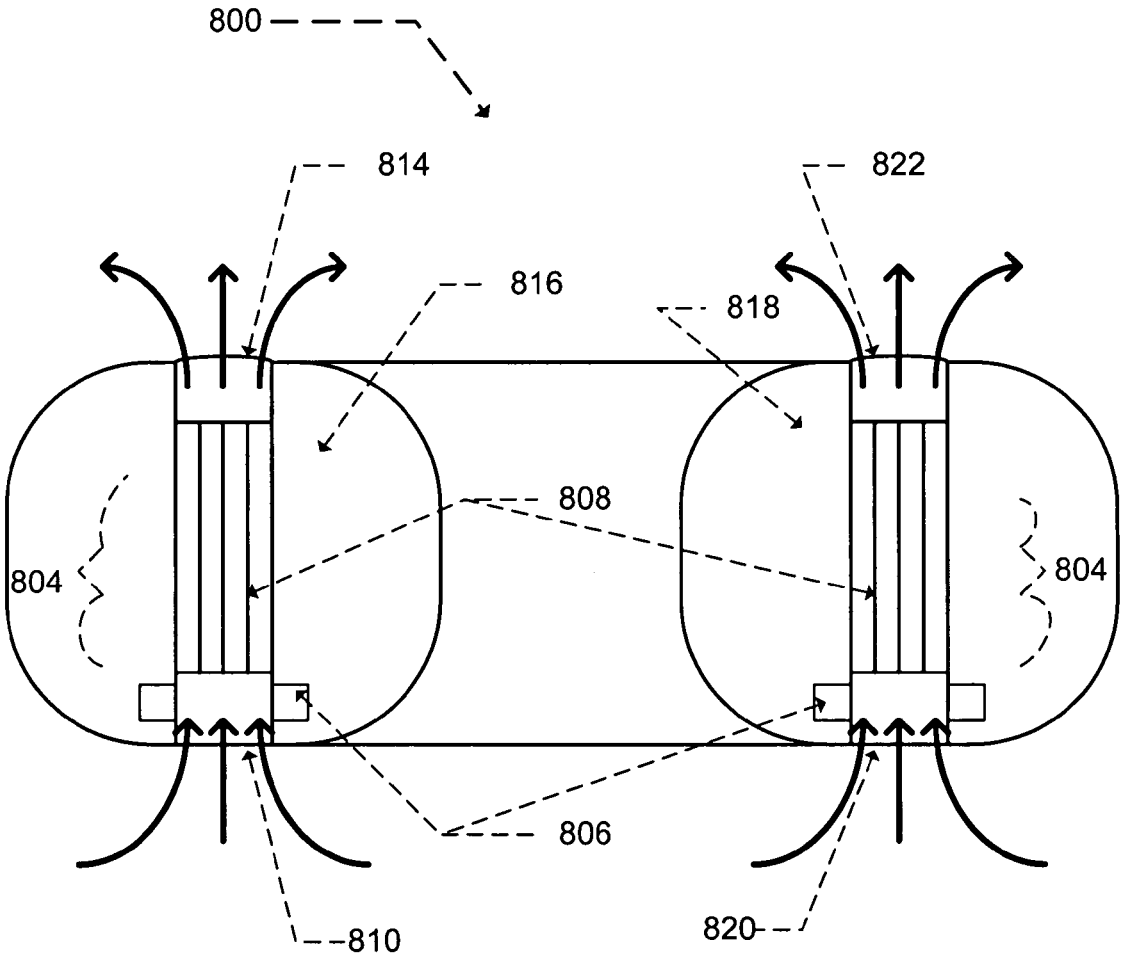
FIG. 8 is a front, cross-sectional view of the pillow with air filter, in accordance with a second exemplary embodiment of the air filter.

FIG. 8 is a front, cross-sectional view of the pillow with air filter 800, in accordance with a second exemplary embodiment of the air filter. In the second exemplary embodiment of the air filter 804, the air filters 804 do not have fans that draw the air through the chambers 816, 818. The air enters through the intake openings 810, 820. The ion generators 806 charge the foreign particles in the air stream. The negatively charged particles are attracted to the charge plates 808 further down stream in the chambers 816, 818. The negatively charged particles are pulled down the chambers 816, 818 along with surrounding air to the charge plates 808. The vacuum created by the removed air and charged particles pulls new air in from the intake openings 810, 820. The constant flow of incoming air into the chambers 816, 818 forces the clean air out of the outflow openings 814, 822 located down stream from the charge plates 808. The second exemplary embodiment reduces the power consumption of the air filters 804.

Figure 9:
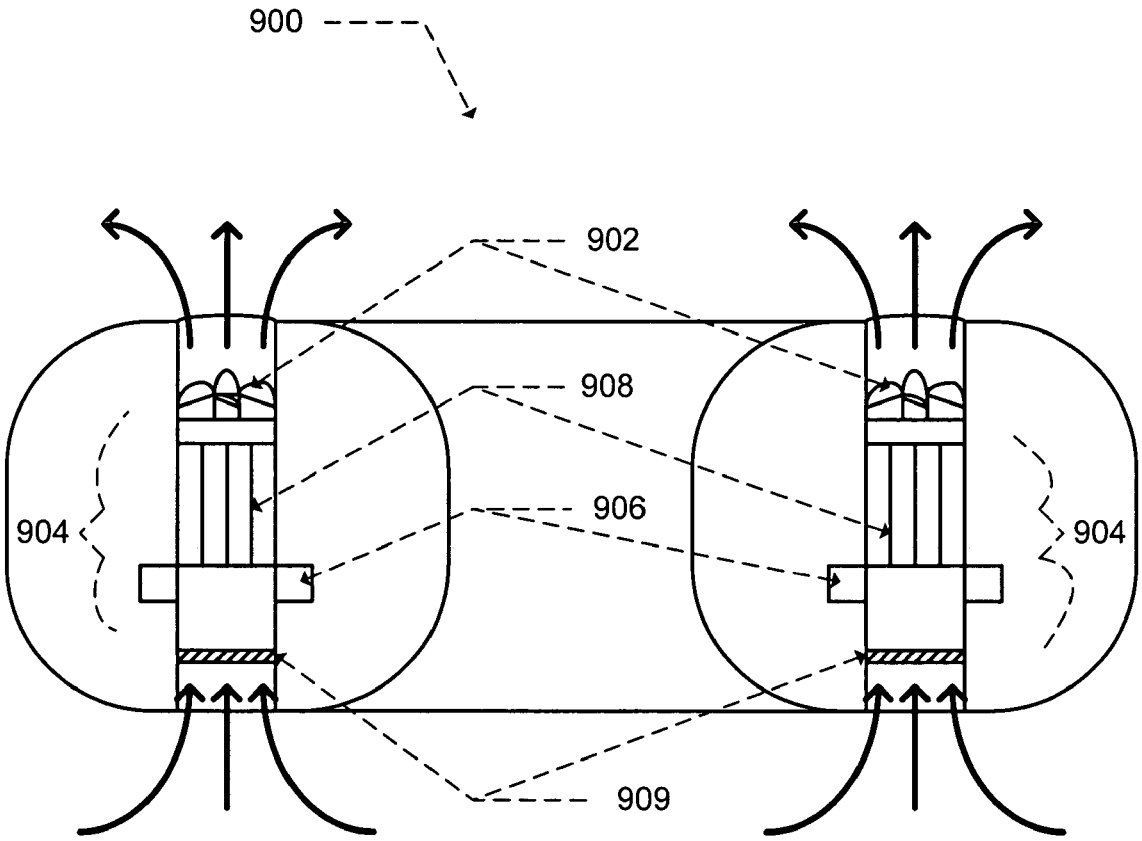
FIG. 9 is a front, cross-sectional view of the pillow with air filter, in accordance with a third exemplary embodiment of the air filter.

FIG. 9 is a front, cross-sectional view of the pillow with air filter 900, in accordance with a third exemplary embodiment of the air filter 904. In this embodiment the fans 902 and the electrostatic precipitator filters are combined with a filter material 909. The filter material 909 can be a sheet of porous material that allows air particles to pass through but prevents the passage of larger foreign particles. In addition to the filter material 909 obstructing foreign particles from passage through pores in the material, the filter material 909 can also be chemically coated. The chemicals can attract and bond with foreign particles in the air stream, for example, smoke or dander. The particles are removed from the air stream and bonded to the filter material 909. In addition to chemicals that attract and bond with foreign particles, the chemicals can also be designed to bond to and kill germs and bacteria. The third exemplary embodiment of the air filter removes some of the foreign particles in the air with a filter material 909 and further removes additional particles with the electrostatic precipitator filters 904, thus providing a greater degree of filtration.

The air filters discussed in the first, second, and third embodiments are exemplary. A variety of other air filter combinations can be used, for example, another air filter combination (not shown) can comprise a fan and a filter material in each chamber without the precipitator filter. Another example can include an ultraviolet light source within the chamber. The ultraviolet light kills germs and bacteria in the air stream. The pillow with air filter is not limited to the above filter embodiments. A variety of other air filters can be used in accordance with the invention.

Figure 10:
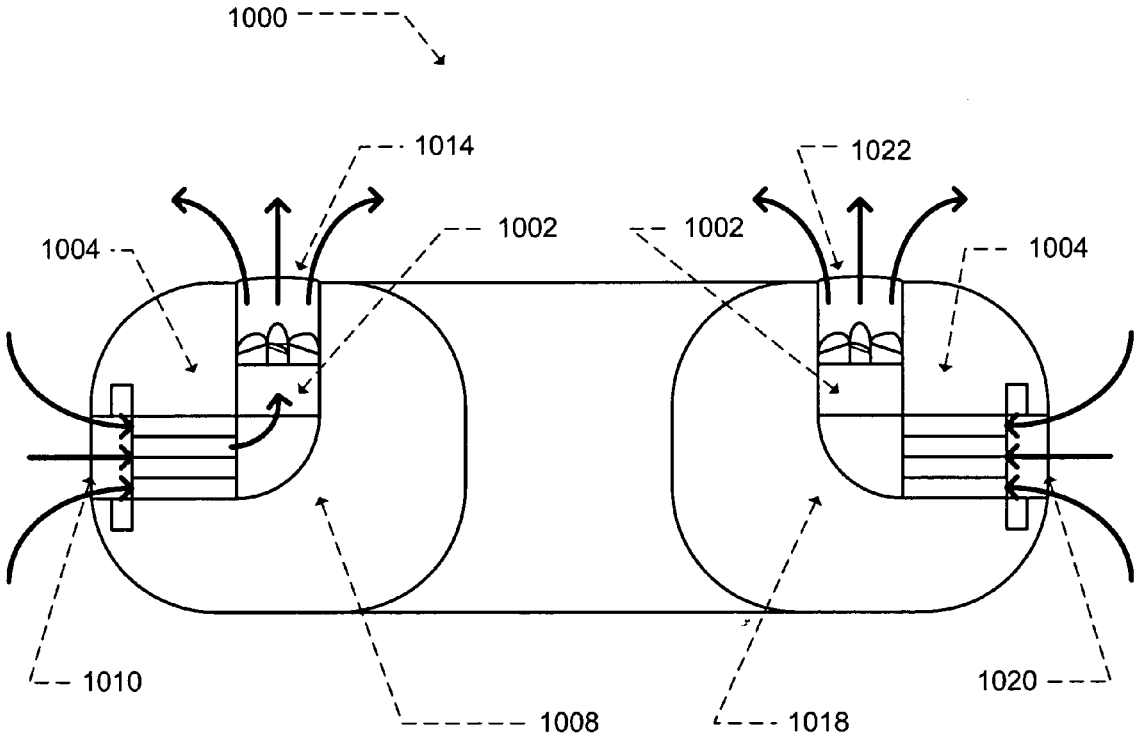
FIG. 10 is a front, cross-sectional view of the pillow with air filter, in accordance with a fourth exemplary embodiment of the air filter.

FIG. 10 is a front, cross-sectional view of the pillow with air filter 1000, in accordance with another air filter combination of the air filter. Similar to the first exemplary embodiment of the air filter, in each chamber 1008, 1018 fans 1002 can be positioned to draw air through the chambers 1008, 1018. The air filters are electrostatic precipitator filters 1004. In the fourth exemplary embodiment, the intake openings 1010, 1020 of the chambers 1008, 1018 are located on a side exterior surface of the pillow. Air is drawn into the intake openings 1010, 1020. The electrostatic precipitator filters 1004 then filter the air. The outflow openings 1014, 1022 are located on the top exterior surface of the pillow. The cleaned air stream, with foreign particle removed, flows out of the outflow openings 1014, 1022 and is directed in front of the nose and mouth of the user. The placement of the chambers 1008, 1018 is not limited to the first and fourth exemplary embodiment. The chambers 1008, 1018 can be located in a variety of locations.

It should be emphasized that the above-described embodiments of the present invention are merely possible examples of implementations merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

What is claimed is:

1. A pillow, comprising:

one or more air filters;

a pillow body with a soft material coupled to the one or more air filters;

a chamber through the pillow body, the chamber having an interior; and a power source coupled to the one or more air filters, wherein at least one of the one or more air filters is located within the interior of the chamber to trap foreign particles inside the pillow body.

2. The pillow of claim 1, wherein each of the one or more air filters has an air intake and an air outflow in communication with an exterior surface of the pillow body.

3. The pillow of claim 1, wherein each of the one or more air filters has an air intake in communication with a bottom surface of an exterior surface of the pillow body and an air outflow in communication with a top surface of the exterior surface of the pillow body.

4. The pillow of claim 1, wherein each of the one or more air filters has an air intake in communication with a side surface of an exterior surface of the pillow body and an air outflow in communication with a top surface of the exterior surface of the pillow body.

5. The pillow of claim 1, wherein the one or more air filters are electrostatic precipitator filters.

6. The pillow of claim 1, wherein the one or more air filters pass the air through a filter material.

7. The pillow of claim 1, wherein the one or more air filters further comprise a fan.

8. The pillow of claim 2, wherein a positionable nozzle directs an air outflow.

9. The pillow of claim 1, wherein the power source is one or more batteries coupled to the soft material.

10. The pillow of claim 1, wherein the pillow body is a U-shaped pillow comprising a back portion, left side portion, and right side portion.

11. A pillow, comprising:

one or more means for filtering air;

a pillow means for supporting coupled to the one or more means for filtering air;

a chamber through the pillow means for supporting, the chamber having an interior; and a power source coupled to the one or more means for filtering air, wherein at least one of the one or more means for filtering is located within the interior of the chamber to trap foreign particles inside the pillow means for supporting.

12. The pillow of claim 11, wherein the means for supporting comprises an inflatable bladder.

13. The pillow of claim 11, wherein each of the one or more means for filtering air has an air intake and an air outflow in communication with an exterior surface of the means for supporting.

14. The pillow of claim 11, wherein each of the one or more means for filtering air has an air intake in communication with a bottom surface of an exterior surface of the means for supporting and an air outflow in communication with a top surface of the exterior surface.

15. The pillow of claim 11, wherein each of the one or more means for filtering air has an air intake in communication with a side surface of an exterior surface of the means for supporting and an air outflow in communication with a top surface of the exterior surface.

16. The pillow of claim 11, wherein the one or more means for filtering air further comprise a fan.

17. The pillow of claim 13, wherein a positionable nozzle directs an air outflow.

18. The pillow of claim 11, wherein the power source is one or more batteries coupled to the soft material.

19. The pillow of claim 11, wherein the means for supporting is U-shaped, comprising a back portion, left side portion, and right side portion.

20. A pillow, comprising:

a U-shaped pillow body comprising a soft core, a fabric cover surrounding the core with an exterior surface, and a chamber located in each arm of the U-shaped pillow body wherein each chamber has an intake end in communication with a bottom surface of the exterior surface and an outflow end in communication with a top surface of the exterior surface;

one or more air filters located within each chamber, the air filters further comprising a fan, an ion generator, and one or more charge plates; and a power source electrically coupled to the one or more air filters.

21. The pillow of claim 20, wherein the one or more air filters further comprises a filter material located in each chamber.

22. The pillow of claim 20, wherein a positionable nozzle is located on the outflow end.

23. The pillow of claim 20, wherein the power source is one or more batteries housed in the pillow body.

24. The pillow of claim 20, wherein the charge plates are removable.

25. A pillow, comprising:

one or more air filters;

a power source coupled to the one or more air filters; and a pillow body with a soft material coupled to the one or more air filters, the pillow body having an exterior surface, wherein each of the one or more air filters is in communication with an air intake positioned on a first surface of the exterior surface and in communication with an air outflow positioned on a second surface of the exterior surface.

26. The pillow of claim 25, wherein the first surface is one of a side surface and a bottom surface, and the second surface is a top surface.

27. A pillow, comprising:

a pillow body with a soft material;

a chamber though the pillow body, the chamber having an interior, an intake opening, and an outflow opening;

a fan positioned in the interior, the fan drawing air through the intake opening and into the interior and blowing the air out of the outflow opening; and an ion generator positioned in the interior to inject ions into the air.

28. The pillow of claim 27, further comprising a charge plate in the interior of the chamber.

29. The pillow of claim 27, further comprising a power source coupled to the ion generator and the fan.

30. The pillow of claim 27, wherein the intake opening is in communication with a bottom surface of an exterior surface of the pillow body and an air outflow in communication with a top surface of the exterior surface of the pillow body.

31. The pillow of claim 27, wherein the intake opening is in communication with a side surface of an exterior surface of the pillow body and the outflow opening is in communication with a top surface of the exterior surface of the pillow body.

32. The pillow of claim 27, wherein a positionable nozzle directs air outflow from the outflow opening.

33. The pillow of claim 29, wherein the power source is one or more batteries.

34. The pillow of claim 27, wherein the pillow body is a U-shaped pillow comprising a back portion, left side portion, and right side portion.

35. A pillow, comprising:

a pillow body with a soft material;

a chamber through the pillow body, the chamber having an interior, an intake opening, and an outflow opening;

a means for removing foreign particles from air entering through the intake opening into the interior and exiting out of the outflow opening; and a power source coupled to the means for removing foreign particles.

36. The pillow of claim 35, wherein the intake opening is in communication with a bottom surface of an exterior surface of the pillow body and an air outflow in communication with a top surface of the exterior surface of the pillow body.

37. The pillow of claim 35, wherein the intake opening is in communication with a side surface of an exterior surface of the pillow body and the outflow opening is in communication with a top surface of the exterior surface of the pillow body.

38. The pillow of claim 35, wherein a positionable nozzle directs air outflow from the outflow opening.

39. The pillow of claim 35, wherein the pillow body is a U-shaped pillow comprising a back portion, left side portion, and right side portion.

* * * * *